US008256638B2

(12) United States Patent
Arvinte et al.

(10) Patent No.: US 8,256,638 B2
(45) Date of Patent: Sep. 4, 2012

(54) PAINT LINER, AND KIT INCLUDING THE SAME

(75) Inventors: Romeo Arvinte, Laval-Des-Rapides (CA); Francois Panfili, Berthierville (CA)

(73) Assignee: A. Richard Tools Co./Outils A. Richard Co., Berthierville (Quebec) (CA)

( * ) Notice: Subject to any disclaimer, the term of this patent is extended or adjusted under 35 U.S.C. 154(b) by 0 days.

(21) Appl. No.: 13/116,555

(22) Filed: May 26, 2011

(65) Prior Publication Data

US 2011/0226776 A1 Sep. 22, 2011

Related U.S. Application Data

(63) Continuation of application No. 12/267,228, filed on Nov. 7, 2008, now Pat. No. 7,963,418, which is a continuation of application No. 29/305,954, filed on Mar. 31, 2008, now Pat. No. Des. 583,521, and a continuation of application No. 29/305,941, filed on Mar. 31, 2008, now Pat. No. Des. 586,515.

(60) Provisional application No. 60/996,224, filed on Nov. 7, 2007.

(51) Int. Cl.
*B65D 25/16* (2006.01)
*B65D 21/00* (2006.01)

(52) U.S. Cl. ..... 220/495.02; 220/570

(58) Field of Classification Search ..... 220/4.22, 220/4.24, 4.26, 495.02, 570; 15/257.06
See application file for complete search history.

(56) References Cited

U.S. PATENT DOCUMENTS

| | | | |
|---|---|---|---|
| 2,999,611 | A | 9/1961 | Paulson |
| 3,157,902 | A | 11/1964 | Hardwick |
| 3,514,012 | A | 5/1970 | Martin |
| D223,664 | S | 5/1972 | Vines |
| D223,864 | S | 6/1972 | Ellsworth et al. |
| 3,828,389 | A | 8/1974 | Heisler |
| D244,827 | S | 6/1977 | Nevai |
| 4,445,250 | A | 5/1984 | Seidl |
| 4,541,542 | A | 9/1985 | Florentino |
| 4,547,926 | A | 10/1985 | Kern |
| 4,651,379 | A | 3/1987 | Kern |
| D289,456 | S | 4/1987 | Florentino |
| D292,533 | S | 10/1987 | Saraga |
| D327,755 | S | 7/1992 | Boyer |

(Continued)

FOREIGN PATENT DOCUMENTS

CA 2532887 A1 7/2006

(Continued)

*Primary Examiner* — Harry Grosso
(74) *Attorney, Agent, or Firm* — Fish & Richardson P.C.

(57) ABSTRACT

A paint liner having a containment area within the paint liner for receiving and containing paint, the containment area defining a peripheral edge provided with a rim, the rim being provided with male and female components, the male and female components of the paint liner being positioned, shaped and sized with respect to one another so that the paint liner can be operated along first and second operating modes, where in the first operating mode the male component of the paint liner is insertable into a corresponding female component of another paint liner so that the paint liners can be nested into one another, and where in the second operating mode the paint liner is turned over so that the male component of the paint liner is insertable into another corresponding female component of the other paint liner in order to have the first paint liner cover the containment area of the other paint liner.

20 Claims, 14 Drawing Sheets

U.S. PATENT DOCUMENTS

| | | | | |
|---|---|---|---|---|
| D332,512 | S | 1/1993 | Bernard | |
| 5,316,137 | A | 5/1994 | Kyllonen | |
| 5,460,289 | A | 10/1995 | Gemmell | |
| D371,876 | S | 7/1996 | Albert et al. | |
| 5,533,228 | A | 7/1996 | Jarecki et al. | |
| 5,553,701 | A | 9/1996 | Jarecki et al. | |
| 5,645,164 | A | 7/1997 | Hocking | |
| D400,329 | S | 10/1998 | Lindo | |
| 5,862,930 | A | 1/1999 | Orkisz | |
| 5,966,772 | A | 10/1999 | Woodnorth et al. | |
| 6,076,225 | A | 6/2000 | Sorenson | |
| 6,196,410 | B1 | 3/2001 | Hocking | |
| D461,288 | S | 8/2002 | Tennant | |
| 6,622,884 | B1 | 9/2003 | Gartner | |
| D489,955 | S | 5/2004 | Concari et al. | |
| 7,083,044 | B1 | 8/2006 | Kilian et al. | |
| D553,817 | S | 10/2007 | Moon et al. | |
| D553,818 | S | 10/2007 | Moon et al. | |
| D571,969 | S | 6/2008 | Byers | |
| 7,963,418 | B2 * | 6/2011 | Arvinte et al. | 220/495.02 |
| 2004/0238399 | A1 | 12/2004 | Billado | |
| 2005/0252920 | A1 | 11/2005 | Cumming et al. | |
| 2006/0157483 | A1 | 7/2006 | Evans et al. | |
| 2007/0151975 | A1 | 7/2007 | Billado | |
| 2008/0029520 | A1 | 2/2008 | Hucks | |
| 2008/0127443 | A1 | 6/2008 | Blanchard | |

FOREIGN PATENT DOCUMENTS

| | | | |
|---|---|---|---|
| CA | 2629676 | A1 | 10/2009 |

* cited by examiner

PAINT LINER, AND KIT INCLUDING THE SAME

FIELD OF THE INVENTION

The present invention relates to a paint liner. More particularly, the present invention relates to an improved paint liner, as well as to a corresponding paint liner kit comprising at least one of such paint liner to be used with a corresponding paint pan, for carrying out painting applications and the like, as well as to a method of use associated thereto. The present application claims priority of U.S. provisional patent application No. 60/996,224 filed on Nov. 7, 2008, and that of U.S. industrial design applications Ser. Nos. 29/305,954 and 29/305,941 both filed on Mar. 31, 2008, the contents of which are incorporated herein by reference.

BACKGROUND OF THE INVENTION

Known in the art are various tools used for carrying out painting applications and the like, such as paint liners, paint pans, paint scrapers, sanders, etc.

More particularly, known to the Applicant are the following US patents, patent applications and industrial designs which describe various paint liners and the like: U.S. Pat. Nos. 3,157,902; 3,514,012; 3,828,389; 4,445,250; 4,541,542; 4,547,926; 4,651,379; 5,316,137; 5,460,289; 5,533,228; 5,553,701; 5,645,164; 5,862,930; 5,966,772; 6,076,225; 6,196,410 B1; 6,622,884 B1; 7,083,044 B1; 2004/0238399 A1; 2005/0252920 A1; 2007/0151975 A1; 2008/0029520 A1; 2008/0127443 A1; Des 223,864; Des 244,827; Des 289,456; Des 292,533; Des 327,755; Des 332,512; Des 371,876; Des 400,329; D461,288 S; D489,955 S; D553,817 S; D553,818 S; and D571,969 S;

It is also known in the art that paint liners are used with paint pans for receiving paint therein in order to carry out painting applications and the like. A substantial drawback associated with conventional paint liners is that very often, they are not designed so as to be properly nested into or secured with respect to a corresponding paint pan, which may result in the paint liner being undesirably displaced or removed from its corresponding paint pan, which may cause paint spillage and other substantial drawbacks.

Another substantial drawback associated with conventional paint liners is that they are not designed to be conveniently covered up so as to prevent paint and/or accessories found therein from drying up and/or being contaminated when the latter are not being used, whether for a short period of time or for more extended periods of time.

Hence, in light of the aforementioned, there is a need for a device, which by virtue of its design and components, would be able to overcome or at least minimize some of the above-discussed prior art problems.

SUMMARY OF THE INVENTION

The object of the present invention is to provide a paint liner, which by virtue of its design and components, satisfies some of the above-mentioned needs and is thus an improvement over other related devices and/or methods known in the prior art.

In accordance with the present invention, the above object is achieved, as will be easily understood, with a paint liner, such as the one briefly described herein, and such as the one exemplified in the accompanying drawings.

The present invention is particularly advantageous in that it relates to at least one such paint liner, to be used with a corresponding paint pan, said paint liner being designed to be used not only as a conventional paint liner, with added features and advantages, as will be described in greater detail hereinbelow, but also intended to be used as a paint cover, as will also be explained in greater detail hereinbelow.

Indeed, according to a first aspect of the present invention, there is provided a paint liner for cooperating with another one of such paint liner, each paint liner comprising:

- opposite front and rear walls, opposite left and right side walls, and a bottom floor, the walls and bottom floor being operatively connected to one another so as to define a containment area within the paint liner for receiving and containing paint therein;
- the walls of the paint liner forming a peripheral edge provided with a rim, said rim being provided with at least one male component protruding from the rim, said at least one male component defining an underlying female component and an adjacent female component along the rim, the male and female components of a same given paint liner being positioned, shaped and sized with respect to one another so that said same paint liner can be operated along first and second operating modes, where in the first operating mode the at least one male component of a first paint liner is insertable into a corresponding underlying female component of a second paint liner so that said first and second paint liners can be nested into one another, and where in the second operating mode the first paint liner is turned over so that the at least one male component of the first paint liner is insertable into a corresponding adjacent female component of the second paint liner in order to have the first paint liner cover the containment area of the second paint liner.

According to another aspect of the present invention, that is, according to a more simplified version thereof, there is also provided a paint liner comprising a containment area within the paint liner for receiving and containing paint therein, the containment area defining a peripheral edge provided with a rim, said rim being provided with male and female components, the male and female components of the paint liner being positioned, shaped and sized with respect to one another so that the paint liner can be operated along first and second operating modes, where in the first operating mode the male component of the paint liner is insertable into a corresponding female component of another paint liner so that said paint liners can be nested into one another, and where in the second operating mode the paint liner is turned over so that the male component of the paint liner is insertable into another corresponding female component of the another paint liner in order to have the paint liner cover the containment area of the another paint liner.

According to yet another aspect of the present invention, there is also provided a method for operating the above-mentioned paint liner and/or paint pan.

According to yet another aspect of the present invention, there is also provided a kit with components for assembling the above-mentioned paint liner and/or paint pan.

According to yet another aspect of the present invention, there is also provided a set of components for interchanging with components of the above-mentioned paint liner kit.

According to yet another aspect of the present invention, there is also provided a method for assembling components of the above-mentioned kit and/or set.

According to another aspect of the present invention, there is also provided a method of manufacturing the above-mentioned paint liner and/or paint pan.

According to another aspect of the present invention, there is also provided a method of doing business with the above-mentioned paint liner, paint pan, kit set and/or methods.

The objects, advantages and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

In the following description, the same numerical references refer to similar elements. The embodiments, geometrical configurations, materials mentioned and/or dimensions shown in the figures are preferred, given for exemplification purposes only.

Moreover, although the present invention was primarily designed for painting applications, as well as carrying out other possible functions related thereto, it may be used with other types of materials and objects and in other fields, as apparent to a person skilled in the art. For this reason, expressions such as "paint", "liner", "pan", "kit", "roll", "tool", etc., as used herein, and/or other suitable derived or alternate expressions, should not be taken as to limit the scope of the present invention and includes all other kinds of materials and/or purposes with which the present invention could be used and may be useful, as apparent to a person skilled in the art.

Moreover, in the context of the present invention, the expressions "kit", "liner", "cover", "pan ", "tool", "device", "unit", "apparatus", "assembly" and any other equivalent expression known in the art will be used interchangeably. Furthermore, the same applies for any other mutually equivalent expressions, such as "cooperating", "receiving", "nesting", "stacking", "piling", "closing", "sealing" and "closing" for example, as well as "another", "other", "second" and "same", as also apparent to a person skilled in the art.

In addition, although the preferred embodiment of the present invention as illustrated in the accompanying drawings comprises various components and although the preferred embodiment of the paint liner 1 and resulting kit 3 (including paint pan 5) as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the paint liner 1 and resulting kit 3, and corresponding parts (e.g. paint pan 5), according to the present invention, as briefly explained and as can be easily inferred herefrom by a person skilled in the art, without departing from the scope of the invention.

Figure 1:
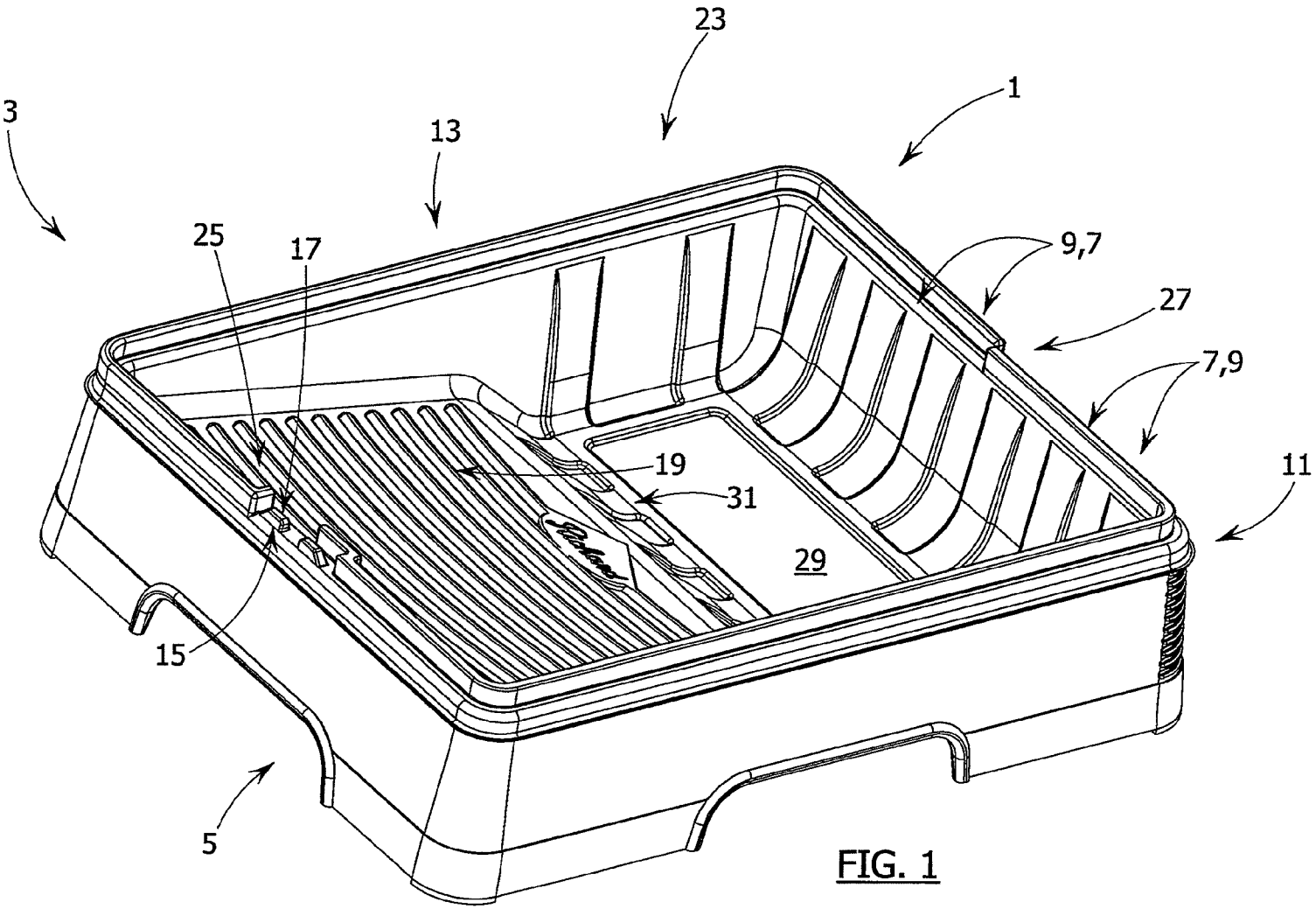
FIG. 1 is a top perspective view of a paint liner kit according to a preferred embodiment of the present invention, the paint liner kit being shown in a first configuration, namely with a paint liner of the kit nested and secured within a corresponding paint pan of said kit.
Figure 2:
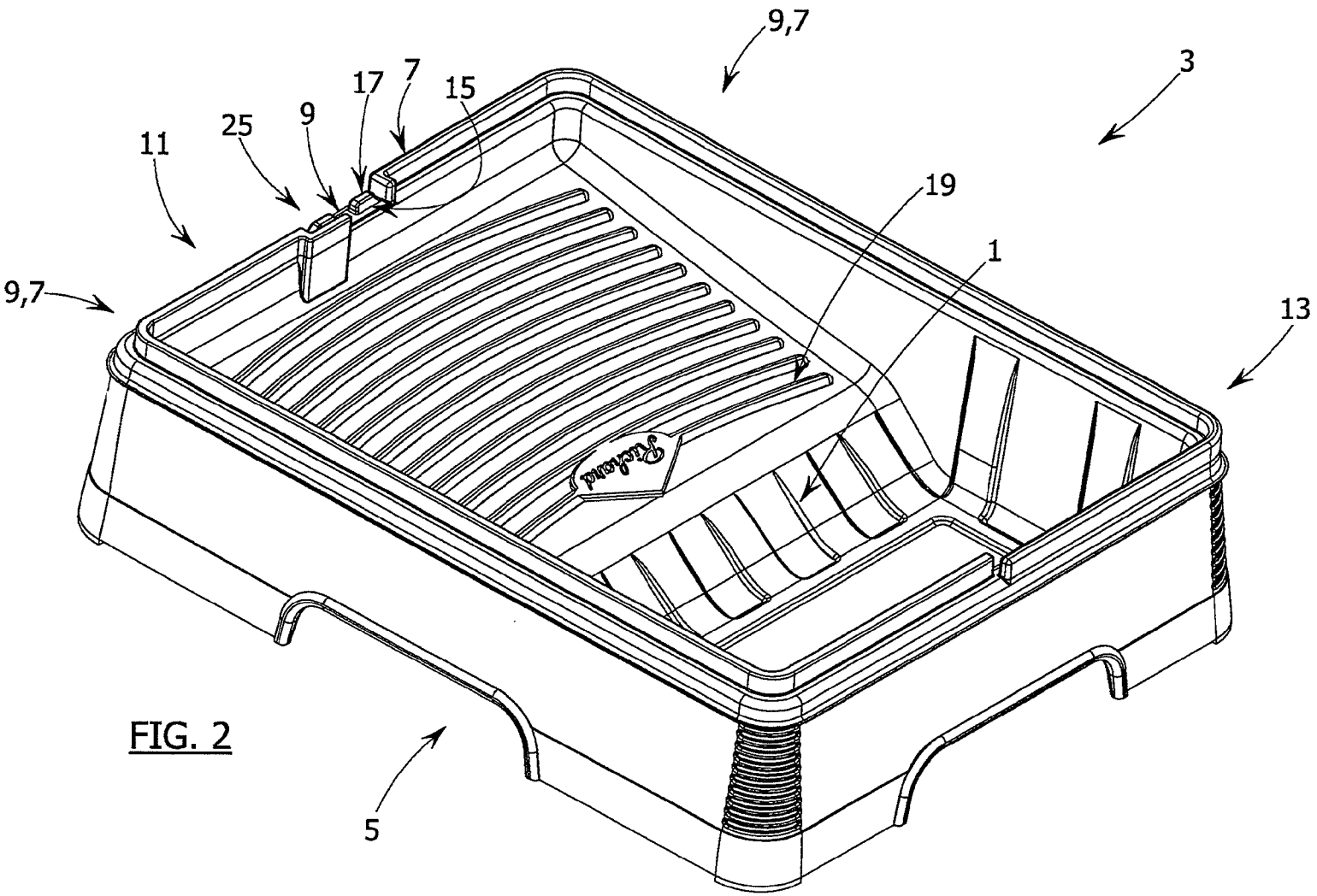
FIG. 2 is another top perspective view thereof.
Figure 3:
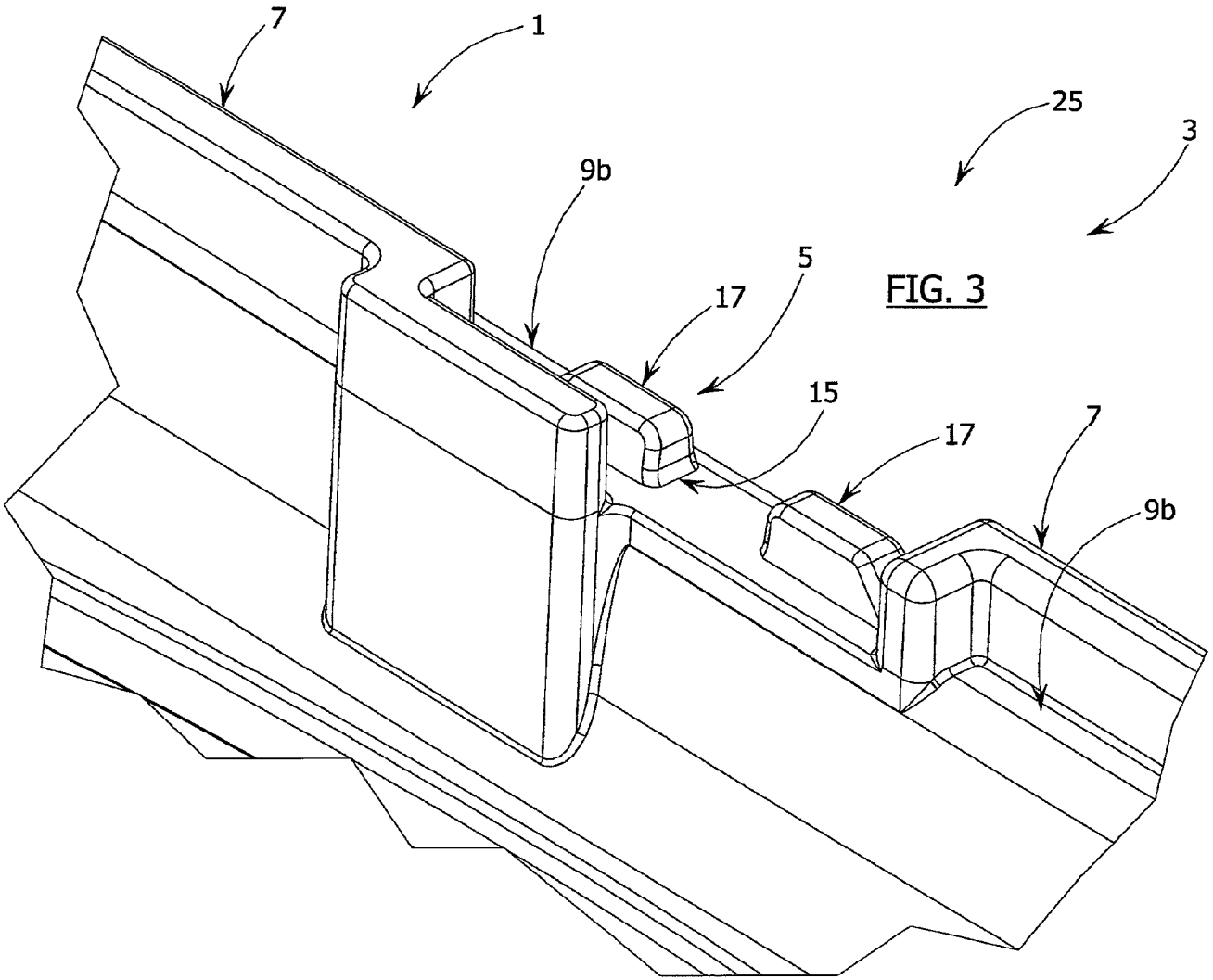
FIG. 3 is a partial enlarged perspective view of a portion thereof.
Figure 5:
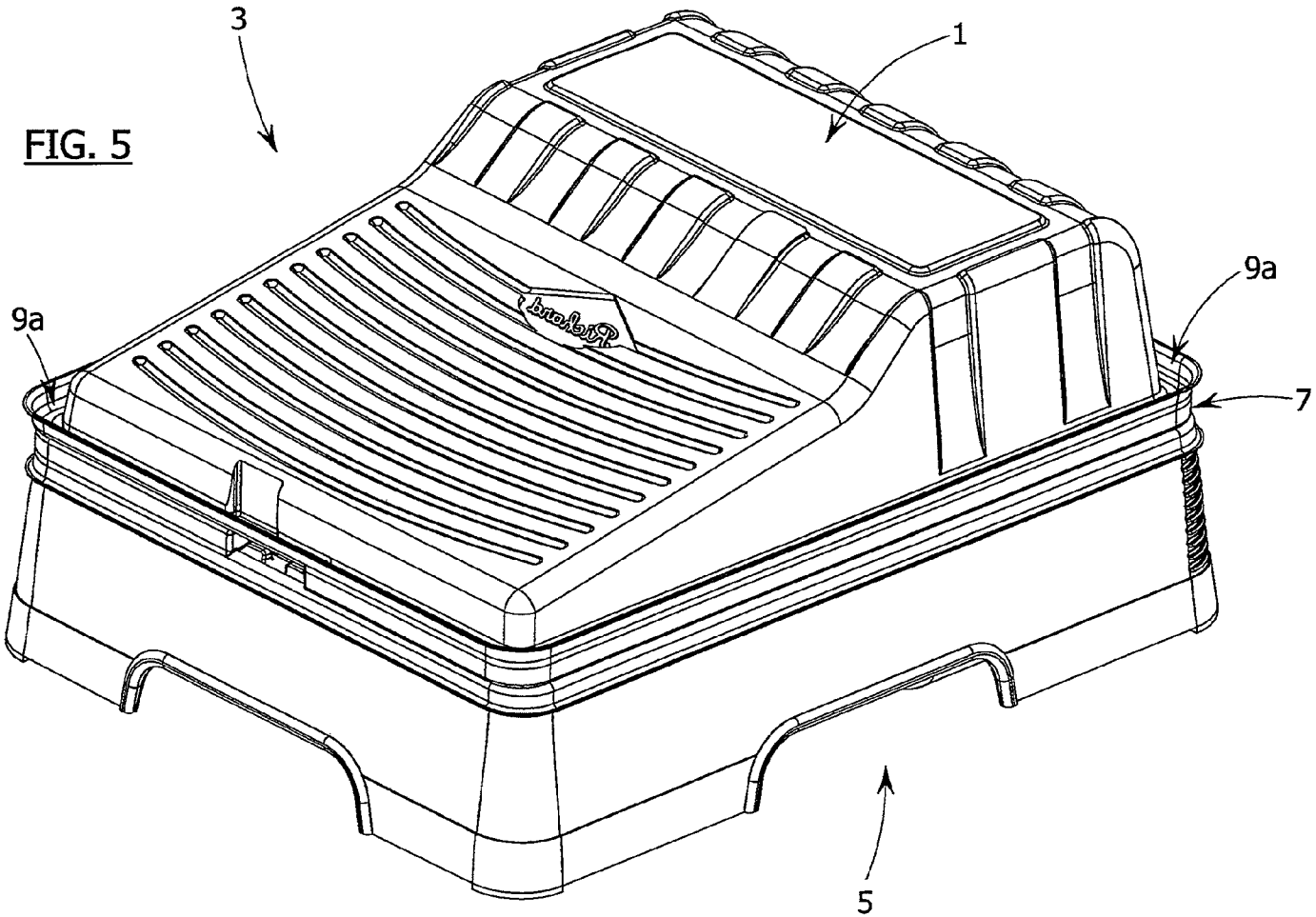
FIG. 5 is another top perspective view thereof, the paint liner kit being now shown in another configuration, namely with another paint liner of the kit secured onto the paint pan and used as a cover therefor.

Broadly described, the paint liner 1 according to the present invention, as shown in the accompanying drawings, is a paint liner 1 comprising both male and female components 7,9 which enable the paint liner 1 to cooperate with another one of such paint liner 1 so as to additionally and selectively act as a paint cover 1, as can be easily understood by a person skilled in the art from the accompanying drawings, particularly when contrasting FIGS. 1 and 5.

Figure 6:
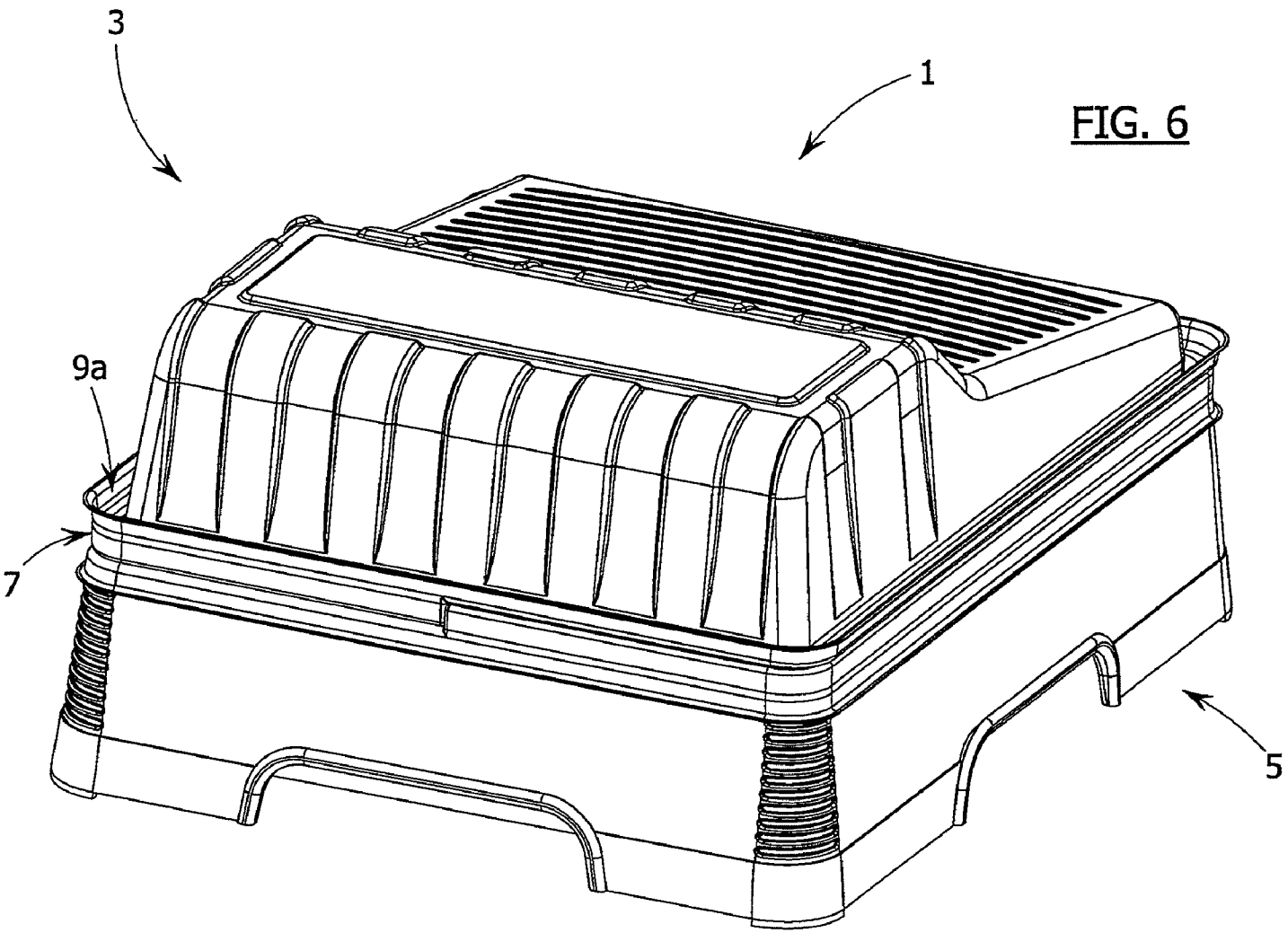
FIG. 6 is another top perspective view of what is shown in FIG. 5.
Figure 7:
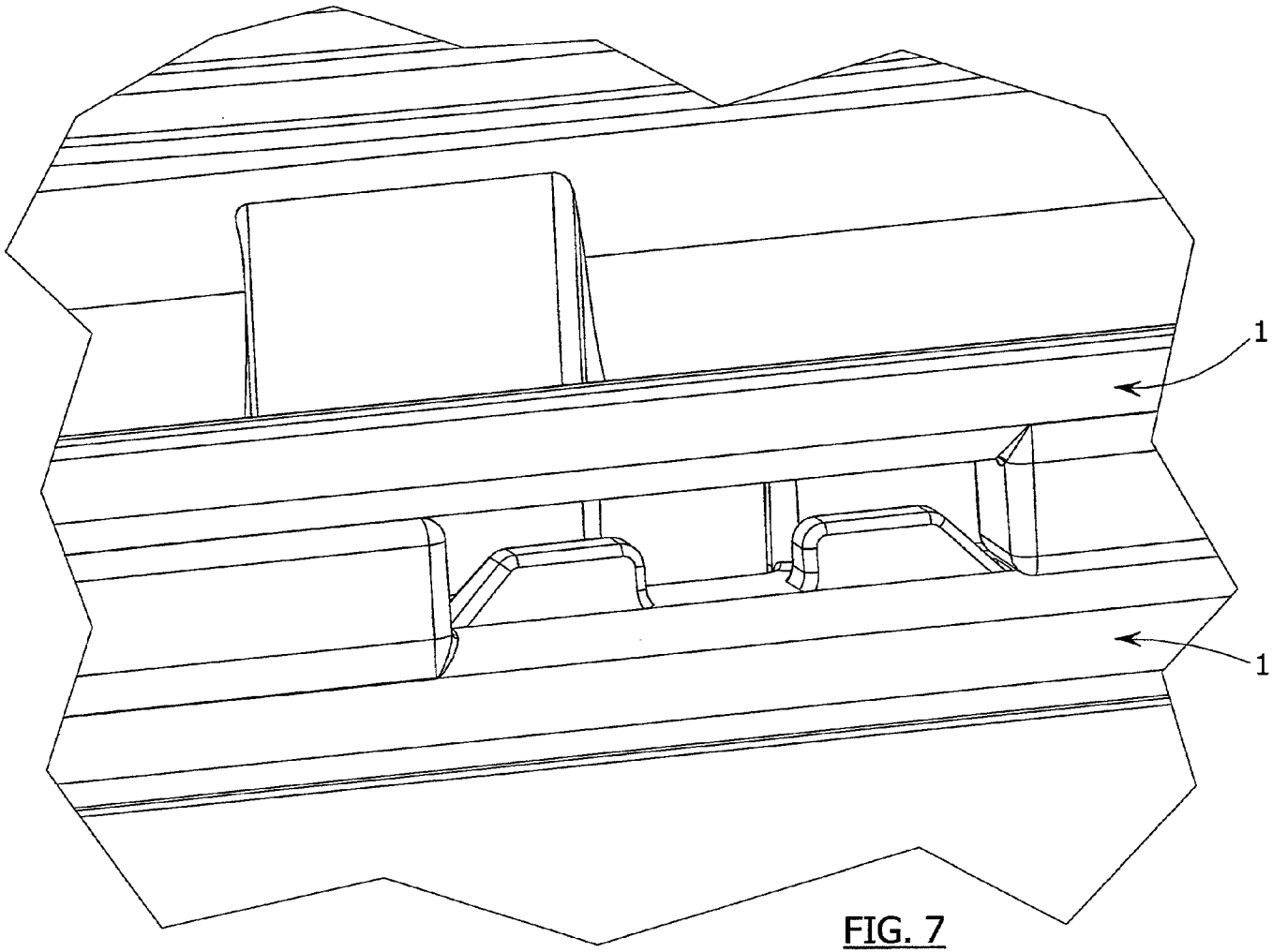
FIG. 7 is a partial enlarged perspective view of a portion of what is shown in FIG. 5.
Figure 11:
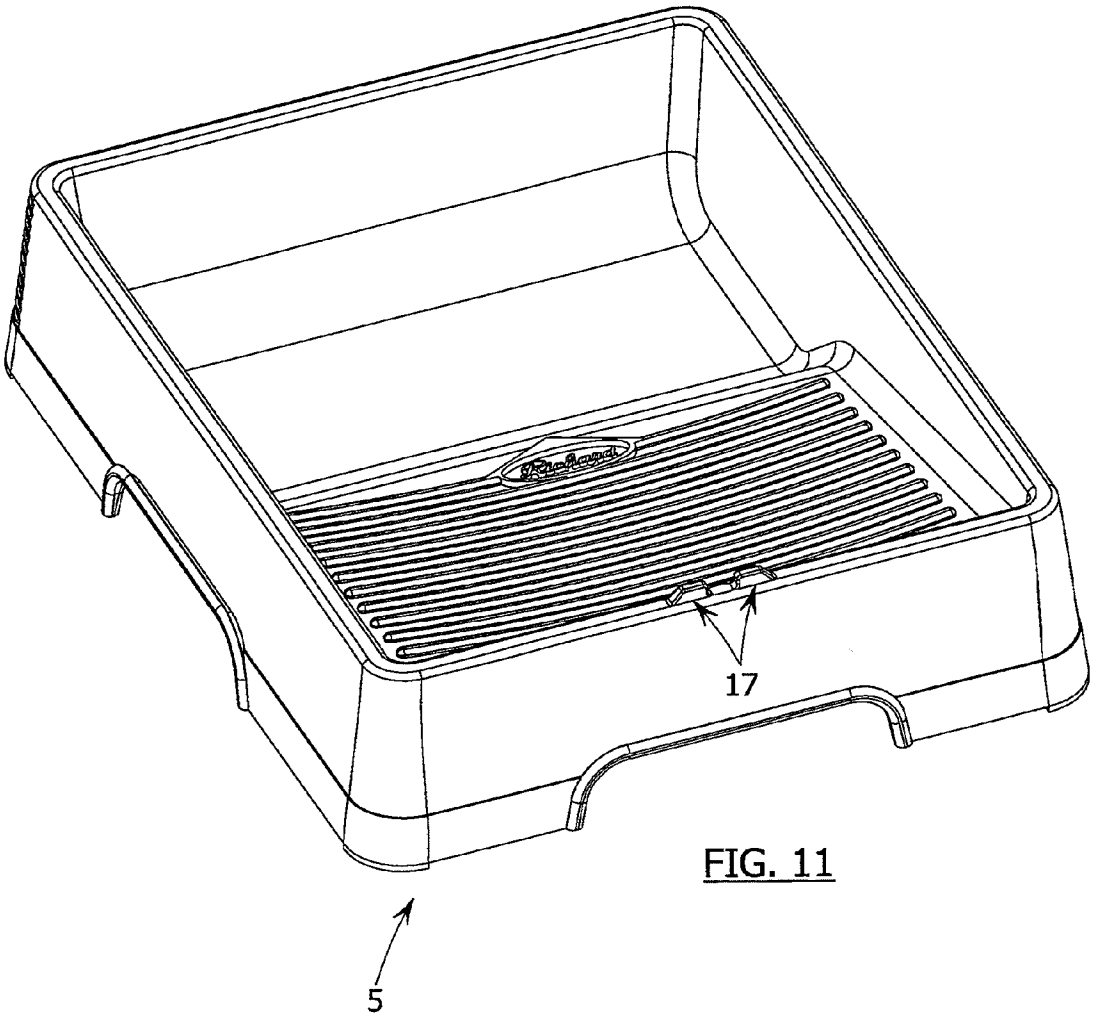
FIG. 11 is a perspective view of the paint pan shown in FIG. 1.
Figure 12:
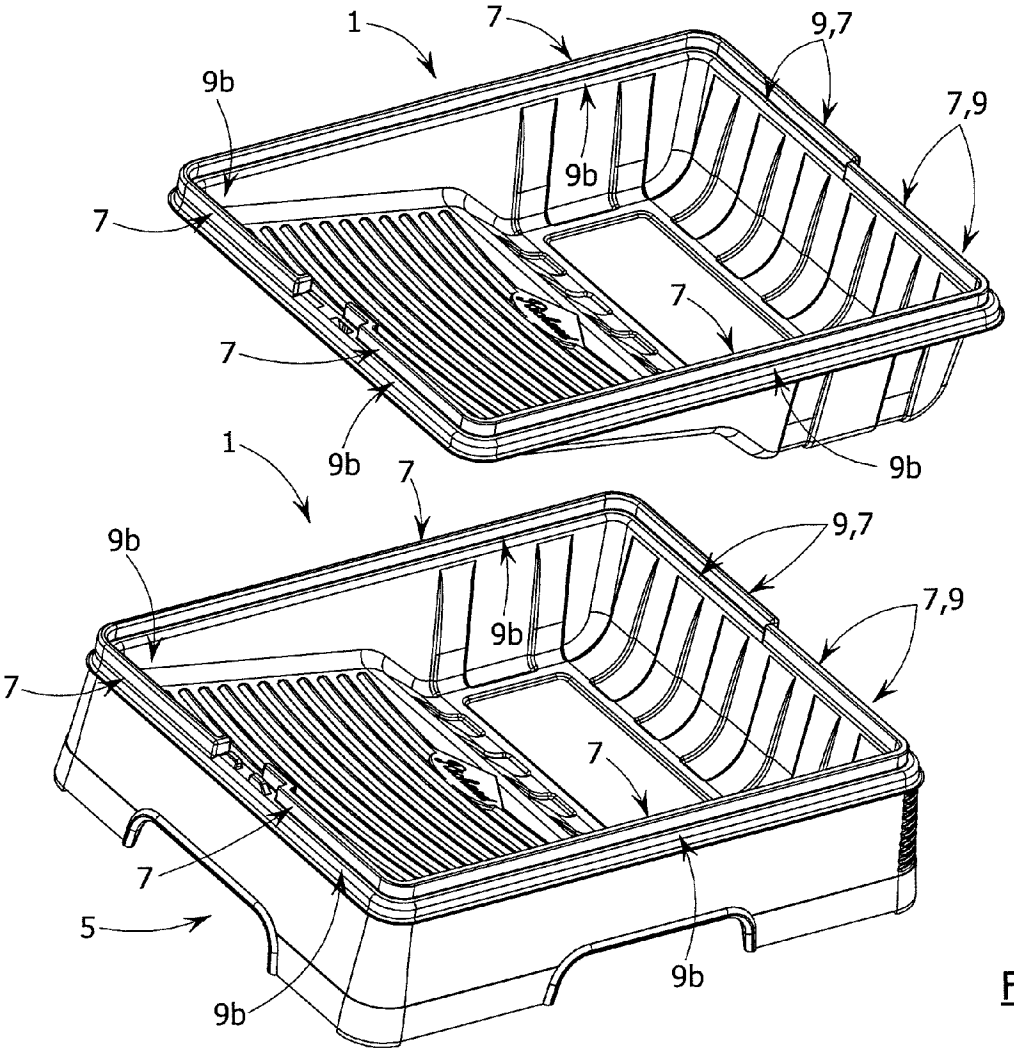
FIG. 12 is another perspective view of the paint liner kit of FIG. 5 in which the top paint liner is shown inverted and in an exploded relationship with respect to the bottom paint liner nested within the paint pan.
Figure 13:
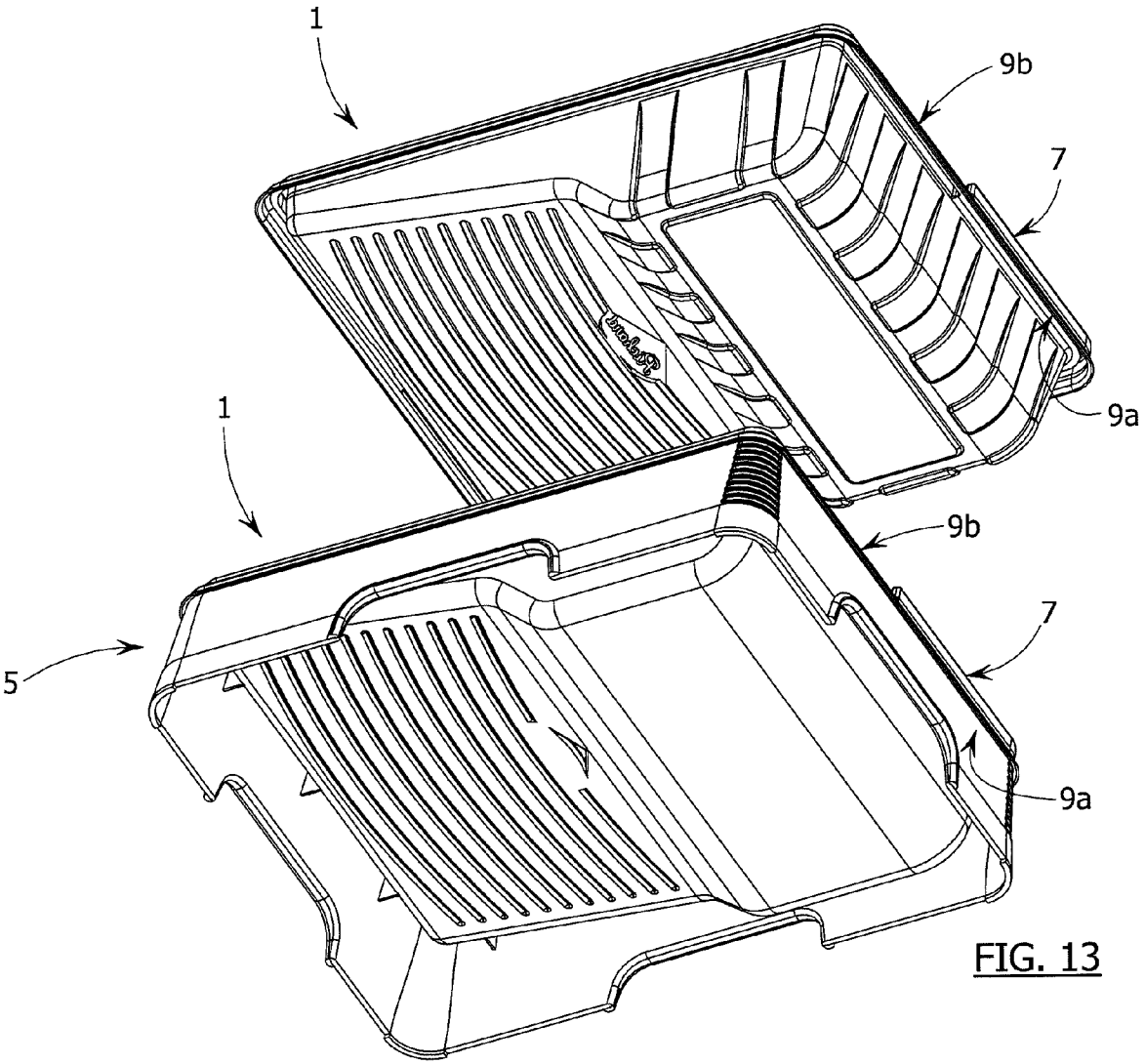
FIG. 13 is a bottom perspective view of the paint liner kit shown in FIG. 12.
Figure 14:
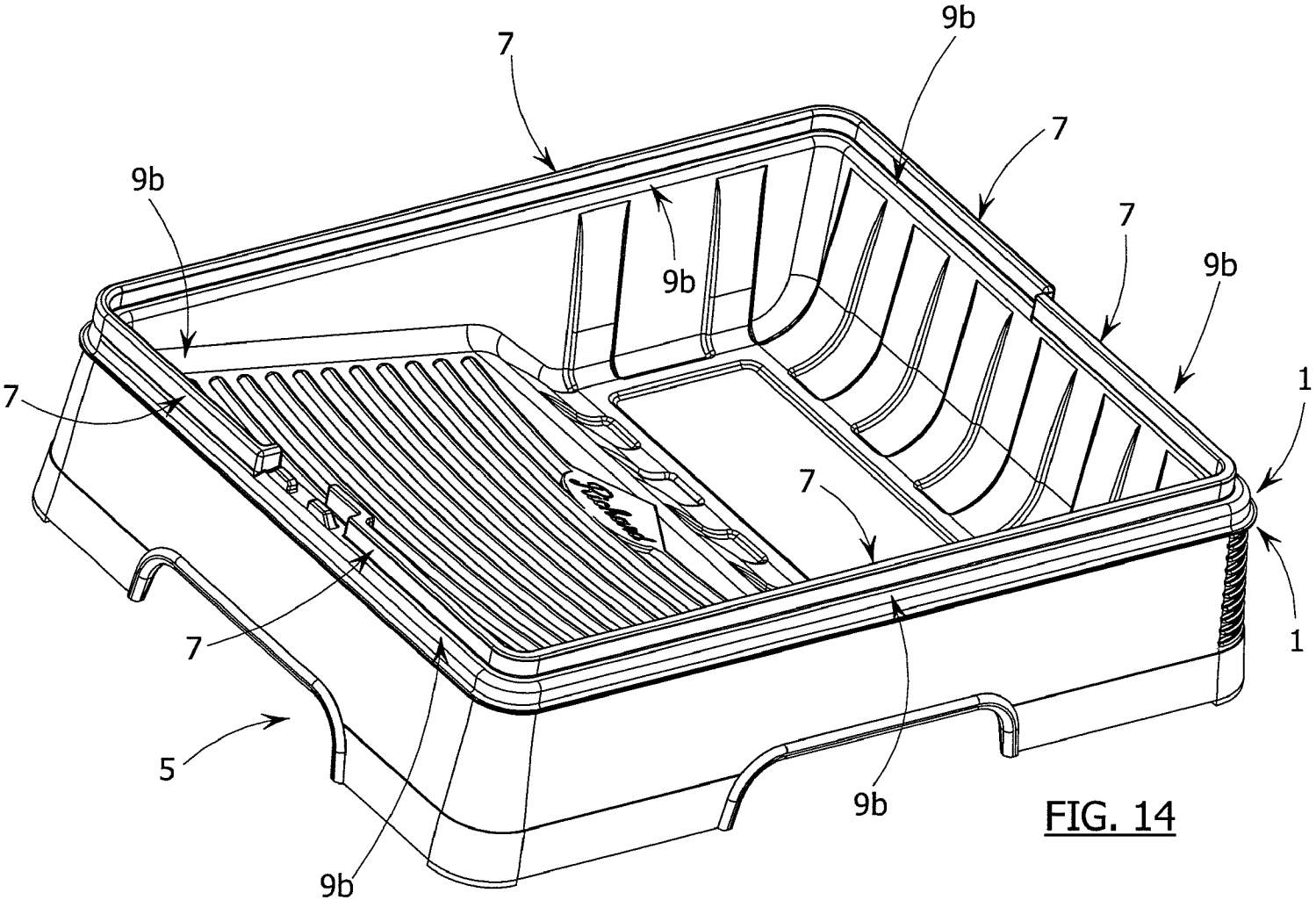
FIG. 14 is another perspective view of the paint liner kit shown in FIG. 12 in which the top paint liner is nested within the bottom paint liner.

Indeed, as better illustrated in the accompanying drawings, the paint liner 1 according to the present invention preferably comprises a peripheral edge 11 comprising a corresponding rim 13 shaped, positioned and sized so as to include corresponding male and female components 7,9 which are to cooperate with complementary female and male components 9,7 of another one of such paint liner 1, so as to selectively act as a cover for this other like paint liner 1 (or corresponding base paint pan 5), as better illustrated in FIGS. 5 and 6. Thus, it may now be better understood that the paint liner 1 according to the present invention may be used with conventional paint pans, so as to provide the added feature of being able to act as a cover 1, as briefly explained hereinbelow, but according to a preferred embodiment of the present invention, there is also provided a kit 3 including at least one of such paint liners 1, and preferably at least a pair of such paint liners 1, and a corresponding and complementary base paint pan 5, whose peripheral edge 11 may or may not be similar to that of the paint liners 1, as shown in FIG. 11, and as can be easily understood by a person skilled in the art.

Indeed, in the case where the peripheral edge of the base paint pan 5 does not comprise a rim 13 including male and female components 7,9 according to the present invention, then the provision of a first paint liner 1 placed onto the base paint pan 5 may, by virtue of its design and components, provide such male and female components 7,9 configured to cooperate with corresponding female and male components 9,7 of another one of such paint liners 1.

It is worth mentioning that according to the present invention, the rim 13 of the paint liner 1 need not be continuous along the entire path of the peripheral edge 11 of said paint liner 1, as illustrated in the accompanying drawings, in that said peripheral edge 11 may be provided with corresponding sections, delimitations, offsets, and the like, depending on the particular applications for which the paint liner 1 is intended and the desired resulting advantages, as apparent to a person skilled in the art.

Indeed, and for example, the paint liner 1 according to the present invention may be provided with at least one slot 15 for receiving at least one protrusion 17 from the base pan 5 so as to ensure a positive lock between the paint liner 1 and the paint pan 5, as can be easily understood by a person skilled in the art when referring to the accompanying drawings, namely FIGS. 1-4. Preferably, and according to a preferred embodiment of the present invention, the paint liner 1 comprises a pair of such slots 15, and the base paint pan 5 comprises a pair of corresponding protrusions 17, as better shown in FIGS. 3 and 4.

Similarly to conventional paint liners, the paint liner 1 according to the present invention is intended to be used with the corresponding paint pan 5 so as avoid or at the very least diminish the soiling thereof. It is generally an accessory that is disposable, and for a limited amount of uses. Very often, the paint liner 1 is made of a recycled material, typically a recycled polymeric material.

According to the preferred embodiment of the present invention, the paint liner 1 is preferably made of a translucid or transparent plastic material. The paint liner 1 according to the present invention also preferably comprises a plurality of ridges 19 which are positioned, shaped and sized so as to ensure an adequate wringing of the paint roll, as can be easily understood by a person skilled in the art.

Moreover, and as better illustrated in the accompanying drawings, the ridges 19 of the paint liner 1 according to the present invention also preferably comprise a half-moon design for ensuring an increased and more efficient wringing of the paint rolls to be used therewith.

Moreover, as briefly explained hereinabove, the contour or peripheral edge 11 of the paint liner 1 along with corresponding parts (rim including male and female sections) enables it to be reversible in order to act as a cover during temporary storing of the paint pan 5 and corresponding paint liners 1 while enabling the paint and the roller inside thereof to maintain its moisture so as to prevent unwanted drying thereof, for a limited period of time, such as for a day for example, or any other longer suitable period of time, as apparent to a person skilled in the art.

Moreover, as also briefly explained hereinabove, the paint liner 1 preferably comprises at least one slot 15, and preferably a pair of such slots 15, intended to cooperate with at least one protrusion 17, and preferably a pair of such protrusions 17, provided on a corresponding portion of the corresponding base pan 5, so as to positively secure the paint liner 1 with respect to the paint pan 5, and provide resulting advantages, such as added securement, ensuring that the paint liner 1 is properly positioned and centered with respect to the base pan 5, and the like.

It is worth mentioning also, as can be understood by a person skilled in the art, that according to the present invention, a same given paint liner 1 may be first used as a conventional paint liner 1, and then used as a paint cover 1 according to the present invention, as can be easily understood by a person skilled in the art in view of the accompanying drawings.

Thus, as may be better appreciated by a person skilled in the art, in view of the present description and the accompanying drawings, the present invention, in one of its simplest forms, relates to a paint liner 1 comprising a containment area 23 within the paint liner for receiving and containing paint therein, the containment area 23 defining a peripheral edge 11 provided with a rim 13, said rim being provided with male and female components 7,9, the male and female components 7,9 of the paint liner 1 being positioned, shaped and sized with respect to one another so that the paint liner 1 can be operated along at least first and second operating modes, where in the first operating mode the male component 7 of the paint liner 1 is insertable into a corresponding female component 9 of another paint liner 1 so that said paint liners 1 can be nested into one another, and where in the second operating mode the paint liner 1 is turned over so that the male component 7 of the paint liner 1 is insertable into another corresponding female component 9 of the other paint liner 1 in order to have the first paint liner 1 cover the containment area 23 of the other paint liner 1.

According to a preferred embodiment of the present invention, there is provided a paint liner 1 for cooperating with another one of such paint liner 1, each paint liner 1 comprising opposite front and rear walls, opposite left and right side walls, and a bottom floor, the walls and bottom floor being operatively connected to one another so as to define a containment area 23 within the paint liner 1 for receiving and containing paint therein. The walls of the paint liner 1 form a peripheral edge 11 provided with a rim 13, said rim 13 being provided with at least one male component 7 protruding from the rim 13, said at least one male component 7 defining an underlying female component 9*a* and an adjacent female component 9*b* along the rim 13, the male and female components 7,9 of a same given paint liner 1 being positioned, shaped and sized with respect to one another so that said same paint liner 1 can be operated along first and second operating modes, where in the first operating mode the at least one male component 7 of a first paint liner 1 is insertable into a corresponding underlying female component 9*a* of a second paint liner 1 so that said first and second paint liners 1 can be nested into one another, and where in the second operating mode the first paint liner 1 is turned over so that the at least one male component 7 of the first paint liner 1 is insertable into a corresponding adjacent female component 9*b* of the second paint liner 1 in order to have the first paint liner 1 cover (i.e. close off, seal, etc.) the containment area 23 of the second paint liner 1.

Figure 4:
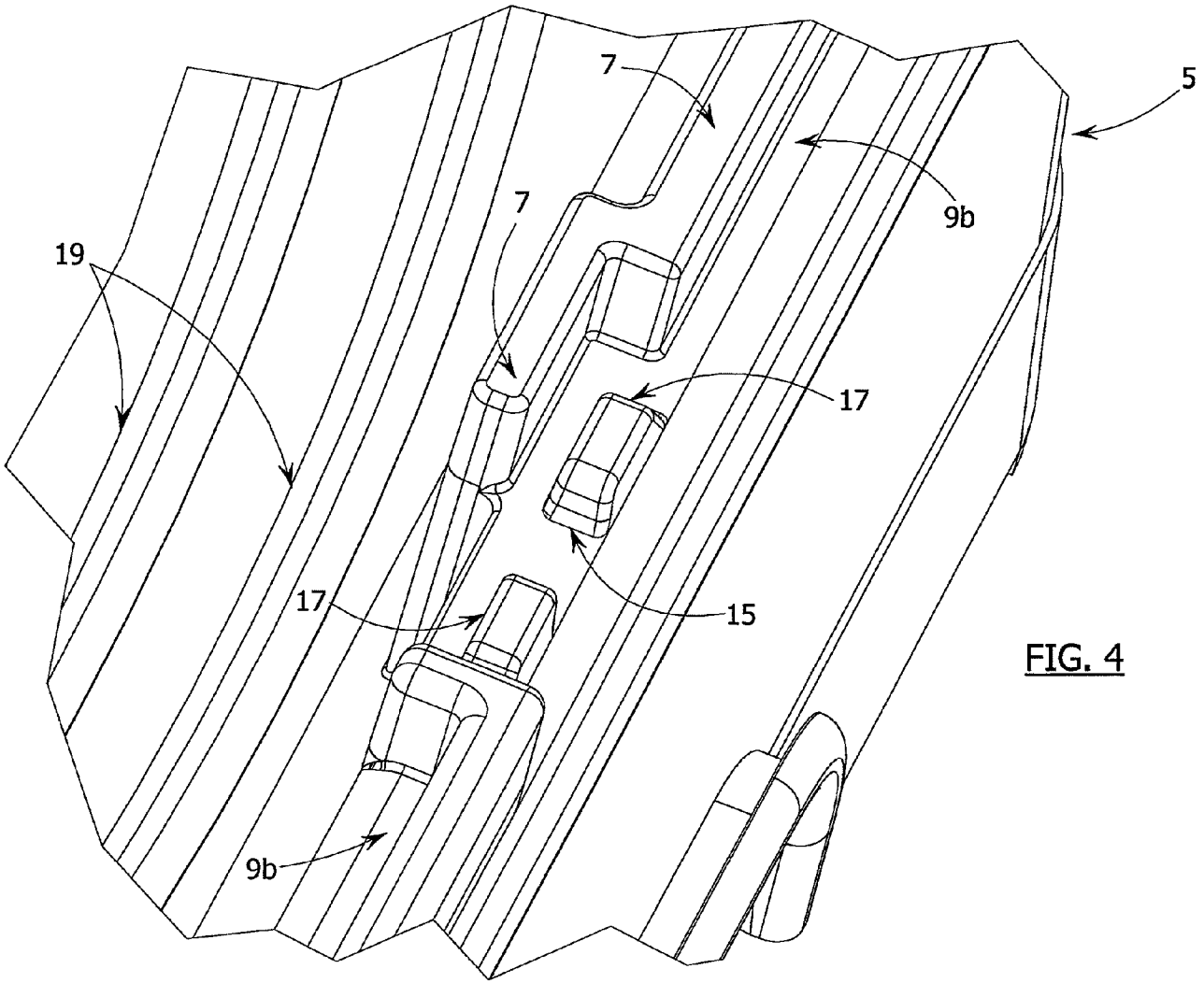
FIG. 4 is another partial enlarged perspective view of another portion thereof.

Preferably, and as can be easily understood by a person skilled in the art when referring to FIGS. 1, 4 and 5, the rim 13 of the paint liner 1 is provided with a pair of male components 7 protruding from the rim 13, each male component 7 protruding from the rim 13 being substantially U-shaped, and each male component 9 extending substantially about halfway along the rim 13, from a first central portion 25 of the rim 13 adjacent to the front wall of the paint liner 1 to a second central portion 27 of the rim adjacent to the rear wall of the paint liner 1.

Figure 8:
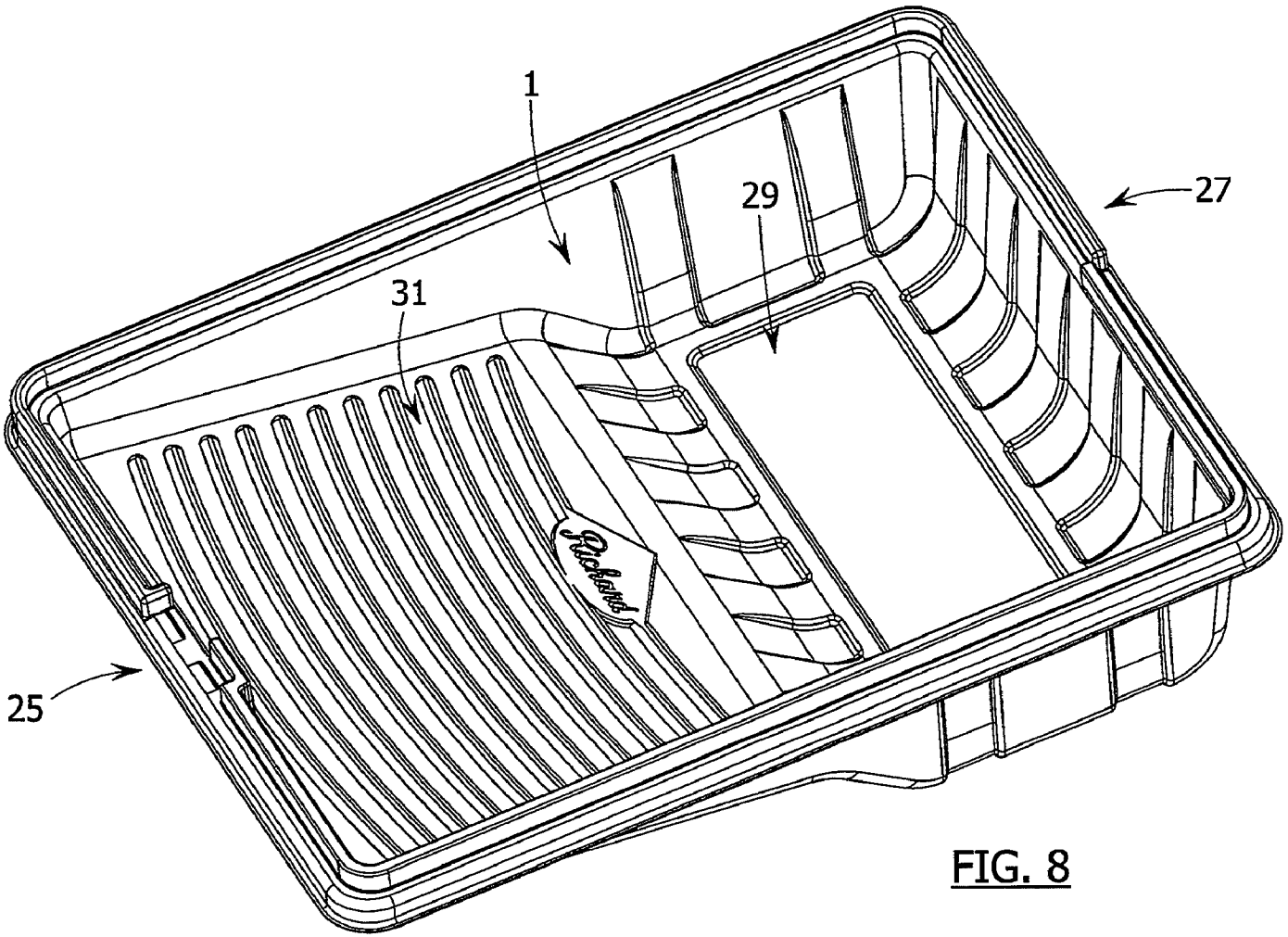
FIG. 8 is a top perspective view of the paint liner shown in FIG. 1.
Figure 9:
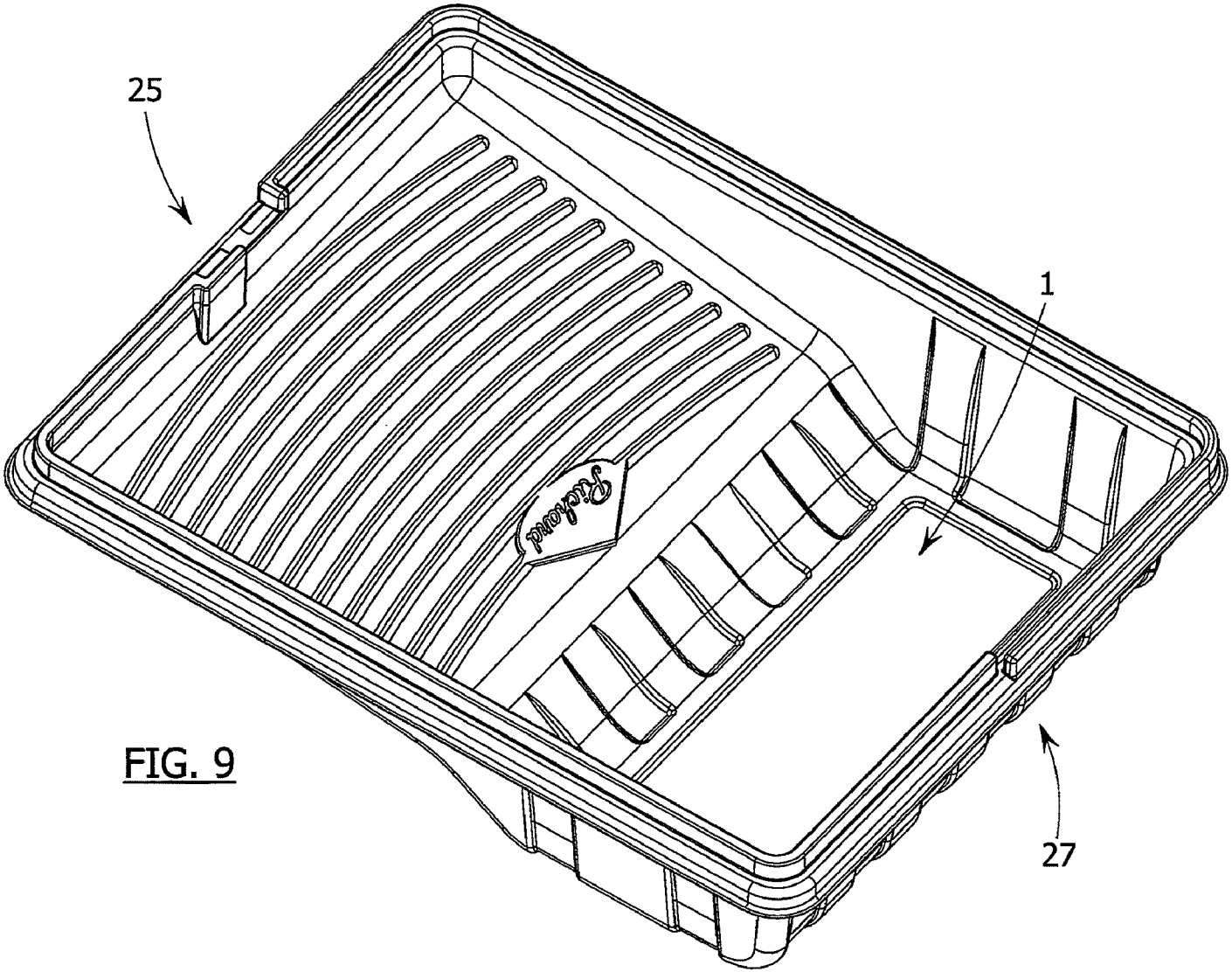
FIG. 9 is another top perspective view of what is shown in FIG. 8.
Figure 10:
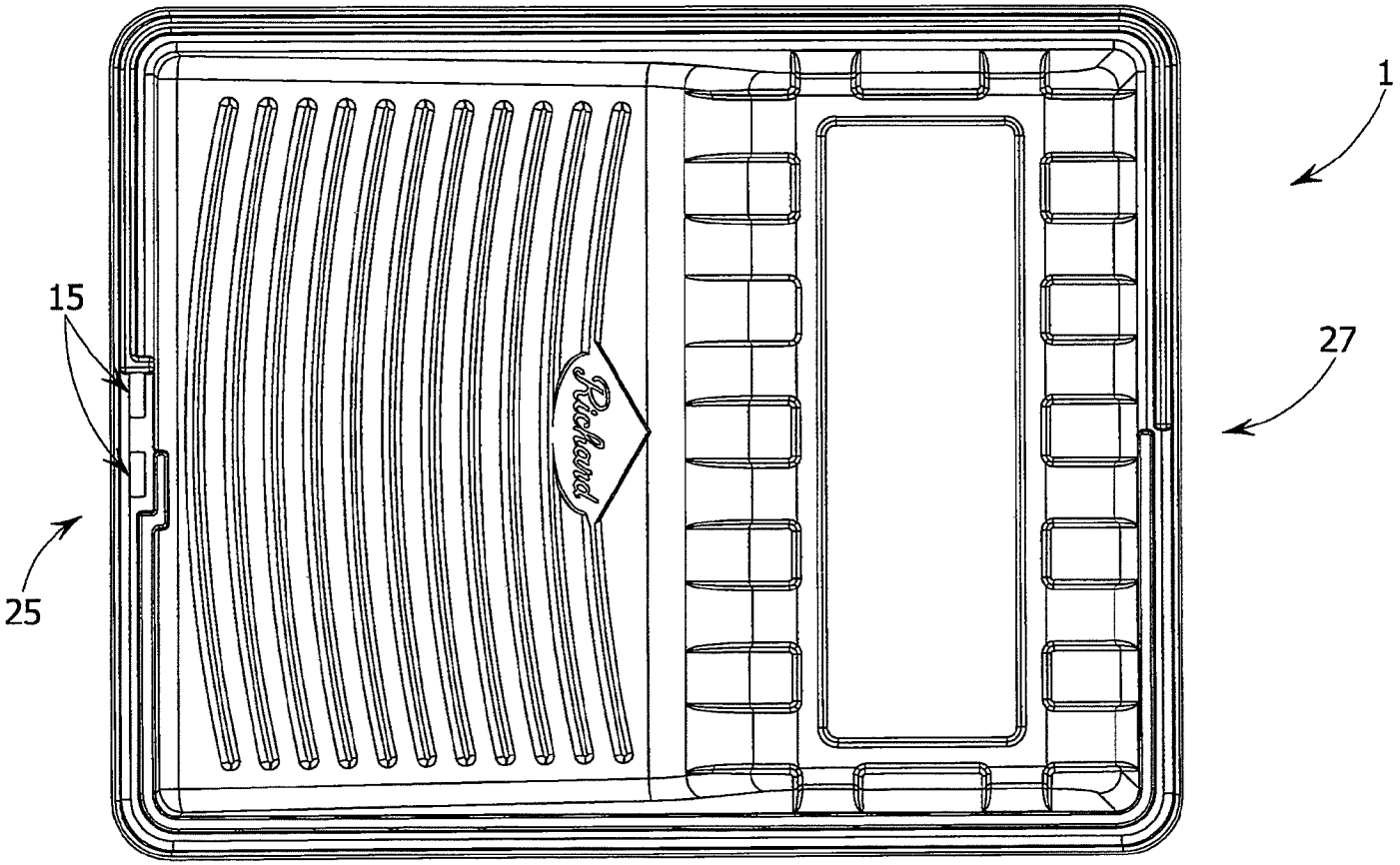
FIG. 10 is a top plan view of what is shown in FIG. 9.

As better shown in FIGS. 8-10, the first central portion 25 of the rim 13 adjacent to the front wall of the paint liner 1 may be provided with at least one slot 15 for receiving at least one corresponding protrusion 17 from a complementary component (i.e. paint pan 5) to be used with the paint liner 1, so as to secure the paint liner 1 with said complementary component.

As better shown in FIGS. 1 and 8, the containment area 23 of the paint liner 1 comprises a recessed portion 29 for containing paint, and an angled wringing portion 31 operatively connected to the recessed portion 29 for wringing paint from a paint tool. The wringing portion 31 may be provided with a plurality of ridges 19 to improve a wringing capability of the paint liner 1. The paint pan 5 of the kit 3 according to the present invention may be provided with components similar and/or complementary to those of the paint liner 1.

Preferably also, the paint liner 1 and/or paint pan 5 may be provided with corresponding ribs, flanges, shoulders, and/or recesses, for appropriately sustaining the corresponding loads to which they may be subjected to, as apparent to a person skilled in the art.

Moreover, the paint liner 1 and/or paint pan 5 according to the present invention preferably comprise an attractive design. Furthermore, the different components of the paint liner kit 3 according to the present invention may include various logos and/or colors which may be various and interchangeable for allowing the manufacturing of different tools depending on different trademarks used, so as to properly represent the manufacturers, distributors, wholesalers, or other parties involved in the commercialization and selling of the tool.

Preferably also, the different components of the paint liner kit 3 are preferably selected so as to be of different colors, and different contrasting colors, so as to provide for a very attractive design of the tool, and so as to enable to commercialize the present tool under the colors of the corresponding manufacturers and the like, for example. Furthermore, the paint liner or other corresponding components of the kit 3 may be provided with suitable continuous or discontinuous strands of numbers, letters, and/or other symbols conveying information, so as to transmit to the user corresponding information regarding the tool, its distributor, and/or its manufacturer, via a corresponding logo for example, or other suitable display of information.

Finally, and according to the present invention, the paint liner kit 3 and corresponding parts are preferably made of substantially rigid materials, such as metallic materials (stainless steel, etc.—particularly for the paint pan 5), hardened polymers, composite materials, and/or the like, whereas other components thereof (e.g. paint liner 1, etc.) according to the present invention, in order to achieve the resulting advantages briefly discussed herein, are preferably made of a suitably malleable and resilient material, such as a polymeric material (plastic, etc.), and/or the like, depending on the particular applications for which the paint liner 1 and resulting kit 3 are intended for and the different parameters in cause (load applied to the paint liner 1 and paint pan 5, etc.), as apparent to a person skilled in the art.

Furthermore, the present invention is a substantial improvement over the prior art in that, by virtue of its design and components, the paint liner 1 is simple and easy to use, as well as is simple and easy to manufacture and/or assemble, without compromising the reliability of its functions. Hence, it may now be appreciated that the present invention represents important advantages over other paint liners 1 known in the prior art, in that by virtue of its designed components, the paint liner 1 may be used to not only be securely mounted onto a corresponding paint pan 5, but also to be used selectively and alternatively as a corresponding paint cover 1, as briefly explained hereinabove.

Of course, numerous modifications could be made to the above-described embodiments without departing from the scope of the invention, as defined in the appended claims.

The invention claimed is:

1. A paint liner for cooperating with another one of such paint liner, each paint liner comprising:

opposite front and rear walls, opposite left and right side walls, and a bottom floor, the walls and bottom floor being operatively connected to one another so as to define a containment area within the paint liner for receiving and containing paint therein;

the walls of the paint liner forming a peripheral edge provided with a rim, said rim being provided with a pair of male components protruding from the rim, each male component defining an underlying female component and an adjacent female component along the rim, the male and female components of a same given paint liner being positioned, shaped and sized with respect to one another so that said same paint liner can be operated along first and second operating modes, where in the first operating mode each male component of a first paint liner is insertable into a corresponding underlying female component of a second paint liner so that said first and second paint liners can be nested into one another, and where in the second operating mode the first paint liner is turned over so that each male component of the first paint liner is insertable into a corresponding adjacent female component of the second paint liner in order to have the first paint liner cover the containment area of the second paint liner.

2. A paint liner according to claim 1, wherein the paint liner is made of a transparent plastic material.

3. A paint liner according to claim 1, wherein each male component protruding from the rim is substantially U-shaped.

4. A paint liner according to claim 1, wherein each male component extends substantially about halfway along the rim, from a first central portion of the rim adjacent to the front wall of the paint liner to a second central portion of the rim adjacent to the rear wall of the paint liner.

5. A paint liner according to claim 1, wherein a first central portion of the rim adjacent to the front wall of the paint liner is provided with at least one slot for receiving at least one corresponding protrusion from a complementary component to be used with the paint liner, so as to secure the paint liner with said complementary component.

6. A paint liner according to claim 1, wherein the containment area of the paint liner comprises a recessed portion for containing paint, and an angled wringing portion operatively connected to the recessed portion for wringing paint from a paint tool.

7. A paint liner according to claim 6, wherein the wringing portion is provided with a plurality of ridges to improve a wringing capability of the paint liner.

8. A paint liner according to claim 1, wherein the rim of the paint liner is provided with a pair of male components protruding from the rim, wherein each male component extends substantially about halfway along the rim, from a first central portion of the rim adjacent to the front wall of the paint liner to a second central portion of the rim adjacent to the rear wall of the paint liner, and wherein each male component protruding from the rim is substantially U-shaped.

9. A paint liner according to claim 8, wherein the first central portion of the rim adjacent to the front wall of the paint liner is provided with at least one slot for receiving at least one corresponding protrusion from a complementary component to be used with the paint liner, so as to secure the paint liner with said complementary component.

10. A paint liner according to claim 9, wherein the containment area of the paint liner comprises a recessed portion for containing paint, and an angled wringing portion operatively connected to the recessed portion for wringing paint from a paint tool, the wringing portion being provided with a plurality of ridges to improve a wringing capability of the paint liner.

11. A paint liner comprising a containment area for receiving and containing paint therein, and a peripheral edge provided with a rim, said rim being provided with a pair of male components protruding from the rim, each male component defining an underlying female component and an adjacent female component along the rim, the male and female components of the paint liner being positioned, shaped and sized with respect to one another so that the paint liner can be operated along first and second operating modes, where in the first operating mode each male component of the paint liner is insertable into a corresponding female component of another paint liner so that said paint liners can be nested into one another, and where in the second operating mode the paint liner is turned over so that each male component of the paint liner is insertable into another corresponding female component of the another paint liner in order to have the paint liner cover the containment area of the another paint liner.

12. A paint liner kit, wherein the kit comprises at least first and second paint liners configured for cooperating with one another, each paint liner comprising:

opposite front and rear walls, opposite left and right side walls, and a bottom floor, the walls and bottom floor being operatively connected to one another so as to define a containment area within each paint liner for receiving and containing paint therein;

the walls of each paint liner forming a peripheral edge provided with a rim, said rim being provided with a pair of male components protruding from the rim, each male component defining an underlying female component and an adjacent female component along the rim, the male and female components of the first paint liner being positioned, shaped and sized with respect to one another so that said first paint liner can be operated along first and second operating modes, where in the first operating mode each male component of the first paint liner is insertable into a corresponding underlying female component of the second paint liner so that said first and second paint liners can be nested into one another, and where in the second operating mode the first paint liner is turned over so that each component of the first paint liner is insertable into a corresponding adjacent female component of the second paint liner in order to have the first paint liner cover the containment area of the second paint liner.

13. A paint liner kit according to claim 12, wherein the paint liner kit further comprises a corresponding paint pan, the paint pan comprising opposite front and rear walls, opposite left and right side walls, and a bottom floor, the walls and bottom floor being operatively connected to one another so as to define a containment area within the paint pan for receiving and containing at least one of the paint liners therein.

14. A paint liner kit according to claim 13, wherein the walls of the paint pan form a peripheral edge provided with a rim, said rim having a central portion adjacent to the front wall of the paint pan and being provided with at least one protrusion, and wherein a central portion of the rim of a given paint liner adjacent to the front wall thereof is provided with at least one slot for receiving said at least one protrusion of the paint pan so as to secure said given paint liner with said paint pan.

15. A paint liner kit according to claim 14, wherein the central portion adjacent to the front wall of the paint pan is provided with a pair of protrusions configured for insertion into a pair of corresponding slots provided on a corresponding central portion of the rim of the given paint liner.

16. A paint liner kit according to claim 12, wherein the paint liner is made of a transparent plastic material.

17. A paint liner kit according to claim 16, wherein for each paint liner, each male component thereof extends substantially about halfway along the rim, from a first central portion of the rim adjacent to the front wall of the paint liner to a second central portion of the rim adjacent to the rear wall of the paint liner.

18. A paint liner kit according to claim 12, wherein the containment area of each paint liner comprises a recessed portion for containing paint, and an angled wringing portion operatively connected to the recessed portion for wringing paint from a paint tool, the wringing portion being provided with a plurality of ridges to improve a wringing capability of the paint liner.

19. A paint liner kit according to claim 13, wherein the containment area of the paint pan comprises a recessed portion for selectively containing paint, and an angled wringing portion operatively connected to the recessed portion for selectively wringing paint from a paint tool, the wringing portion being provided with a plurality of ridges to improve a wringing capability of the paint pan.

20. A paint liner kit according to claim 19, wherein components of the paint pan are complementary in shape and size with respect to corresponding components of each paint liner.

* * * * *